US007549247B1

(12) United States Patent
Reese

(10) Patent No.: US 7,549,247 B1
(45) Date of Patent: Jun. 23, 2009

(54) PORTABLE SHOOTING BENCH ASSEMBLY

(76) Inventor: Roger Reese, 13671 96th Ave., Chippewa Falls, WI (US) 54729

( * ) Notice: Subject to any disclaimer, the term of this patent is extended or adjusted under 35 U.S.C. 154(b) by 494 days.

(21) Appl. No.: 11/502,159

(22) Filed: Aug. 11, 2006

(51) Int. Cl.
*F41C 27/00* (2006.01)

(52) U.S. Cl. ..... 42/94; 89/37.04; 89/37.03; 89/37.13

(58) Field of Classification Search ..... 42/94; 89/37.03, 37.04, 37.13
See application file for complete search history.

(56) References Cited

U.S. PATENT DOCUMENTS

| | | | | |
|---|---|---|---|---|
| 2,627,209 | A | 2/1953 | Green et al. | |
| 3,667,773 | A * | 6/1972 | Hess | 33/299 |
| 3,711,984 | A | 1/1973 | Dyer et al. | |
| 4,026,057 | A | 5/1977 | Cady | |
| 4,506,466 | A | 3/1985 | Hall | |
| 4,563,829 | A | 1/1986 | Bozick | |
| 5,060,410 | A | 10/1991 | Mueller | |
| 5,173,563 | A | 12/1992 | Gray | |
| 5,271,175 | A | 12/1993 | West, III | |
| 5,375,905 | A | 12/1994 | Flitter et al. | |
| 5,414,949 | A | 5/1995 | Peebles | |
| 5,491,919 | A | 2/1996 | Rather et al. | |
| 5,491,921 | A | 2/1996 | Allen | |
| 5,933,999 | A | 8/1999 | McClure et al. | |
| 5,937,561 | A | 8/1999 | Abernethy | |
| 6,058,641 | A | 5/2000 | Vecqueray | |
| 6,269,578 | B1 | 8/2001 | Callegari | |
| 6,338,218 | B1 | 1/2002 | Hegler | |
| 6,546,662 | B1 | 4/2003 | Chong | |
| 6,574,899 | B1 | 6/2003 | Mostello | |
| 6,877,266 | B1 | 4/2005 | Brownlee | |
| 6,931,777 | B1 | 8/2005 | Krien | |
| 6,935,064 | B1 | 8/2005 | Thompson | |
| 2008/0163534 | A1 * | 7/2008 | Lombardi | 42/94 |

* cited by examiner

*Primary Examiner*—Stephen M Johnson
*Assistant Examiner*—Daniel J Troy
(74) *Attorney, Agent, or Firm*—Tipton L. Randall

(57) ABSTRACT

A portable shooting bench assembly has a base chassis assembly with a wheel member that contacts a support surface upon elevating one end of the base chassis assembly. An L-shaped turret chassis member is pivotally mounted at a first end to the base chassis assembly and follows the contour thereof. The turret chassis member's second end is supported on a roller member that contacts the base chassis assembly with a seat member secured above the roller member. The first end of the turret chassis member contains a vertically telescoping section, having an offset support arm member and a linear, rifle support assembly adjustably secured thereto. A hunter seated on the seat member moves himself and his rifle positioned in the rifle support assembly by pivoting the second end of the turret chassis assembly on the roller member along the base chassis assembly.

19 Claims, 6 Drawing Sheets

PORTABLE SHOOTING BENCH ASSEMBLY

CROSS-REFERENCE TO RELATED APPLICATIONS, IF ANY

Not applicable.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to a shooting bench assembly and, more particularly, to a shooting bench assembly for a rifle and, most particularly, to a portable shooting bench assembly for a rifle.

2. Background Information

Various supports for steadying a firearm weapon when discharged have been developed. Shooting ranges often provide a shooting bench with a seat for use by individuals when sighting in a weapon or for target practice. Such shooting benches at a shooting range are stationary, providing a very stable foundation for supporting the firearm weapon. Numerous individuals have devised portable weapons support devices, including portable shooting benches, for use when hunting. Some of these devices have been granted patents, including the following.

U.S. Pat. No. 2,627,209 by Green et al., U.S. Pat. No. 3,711,984 by Dyer et al., U.S. Pat. No. 4,026,059 by Cady, U.S. Pat. No. 4,506,466 by Hall, U.S. Pat. No. 4,563,829 by Bozick, U.S. Pat. No. 5,060,410 by Mueller, U.S. Pat. No. 5,173,563 by Gray, U.S. Pat. No. 5,271,175 by West, III, U.S. Pat. No. 5,375,905 by Flitter et al., U.S. Pat. No. 5,414,949 by Peebles, U.S. Pat. No. 5,491,919 by Rather et al., U.S. Pat. No. 5,491,921 by Allen, U.S. Pat. No. 5,933,999 by McClure et al., U.S. Pat. No. 5,937,561 by Abernethy, U.S. Pat. No. 6,058,641 by Vecqueray; U.S. Pat. No. 6,269,578 by Callegari, U.S. Pat. No. 6,338,218 by Hegler; U.S. Pat. No. 6,546,662 by Chong, U.S. Pat. No. 6,574,899 by Mostello, U.S. Pat. No. 6,877,266 by Brownlee, U.S. Pat. No. 6,931,777 by Krien, and U.S. Pat. No. 6,935,064 by Thompson.

Applicant has devised a portable shooting bench assembly that is easily transported over any terrain by a single individual. The portable shooting bench assembly provides a stable foundation for supporting a firearm weapon, and is adjustable to accommodate hunters of various stature.

SUMMARY OF THE INVENTION

The invention is directed to a portable shooting bench assembly, comprising a base chassis assembly that includes a horizontally oriented T-shaped member having an arm section and a leg section intersecting a midpoint of the arm section. The T-shaped member includes a pair of adjustable support members, with one support member attached vertically at each end of a common side of the arm section. A rigid, vertical support and wheel housing member is attached to the leg section opposite the arm section. The support and wheel housing member has a top end extending above the T-shaped member and a bottom end extending below the T-shaped member. A wheel member is mounted vertically within the support and wheel housing member. The adjustable support members and the bottom end of the support and wheel housing member are in contact with a support surface, when the T-shaped member is in a horizontal orientation. The wheel member contacts the support surface upon elevating the arm section of the base chassis assembly. An L-shaped turret chassis member, having first and second ends, is pivotally mounted at a first end to the top end of the vertical support and wheel housing member and follows the contour of the base chassis assembly. The turret chassis member's second end extends to the midpoint of the arm section, with the turret chassis member's second end supported on at least one roller member that contacts the arm section of the T-shaped member. A seat member is secured to the turret chassis member's second end opposite the at least one roller member. The seat member is adapted to support an individual as the second end of the turret chassis member pivots in an arc along the arm section of the T-shaped member. The first end of the turret chassis member contains a vertically telescoping section having an offset support arm member extending to one side thereof. The support arm member is oriented parallel to the T-shaped member's arm section. A linear, rifle support assembly is adjustably secured to the offset arm member, with the rifle support assembly oriented parallel to the T-shaped member's leg section. The rifle support assembly includes a pair of spaced apart rifle supports to cradle a rifle place there upon. Thus, a hunter seated on the seat member moves himself and his rifle positioned in the support assembly by pivoting the second end of the turret chassis assembly on the at least one roller member along the T-shaped member's arm section.

In a further embodiment of the invention, the shooting bench assembly includes a brake assembly for anchoring the turret chassis member at a selected position. The brake assembly includes a linear, stationary member, secured perpendicularly to the T-shaped member's leg section and parallel to the T-shaped member's leg section. A brake member is adjustably secured to the turret chassis member. Movement of the brake member into contact with the stationary member prevents pivoting of the turret chassis member relative to the base chassis assembly.

In yet a further embodiment of the invention, the vertically telescoping section, with offset support arm extending to one side of the turret chassis member, is removable from the turret chassis member, allowing the offset support arm to extend to either side of the turret chassis member.

DESCRIPTION OF THE EMBODIMENTS

Nomenclature

Figure 1:
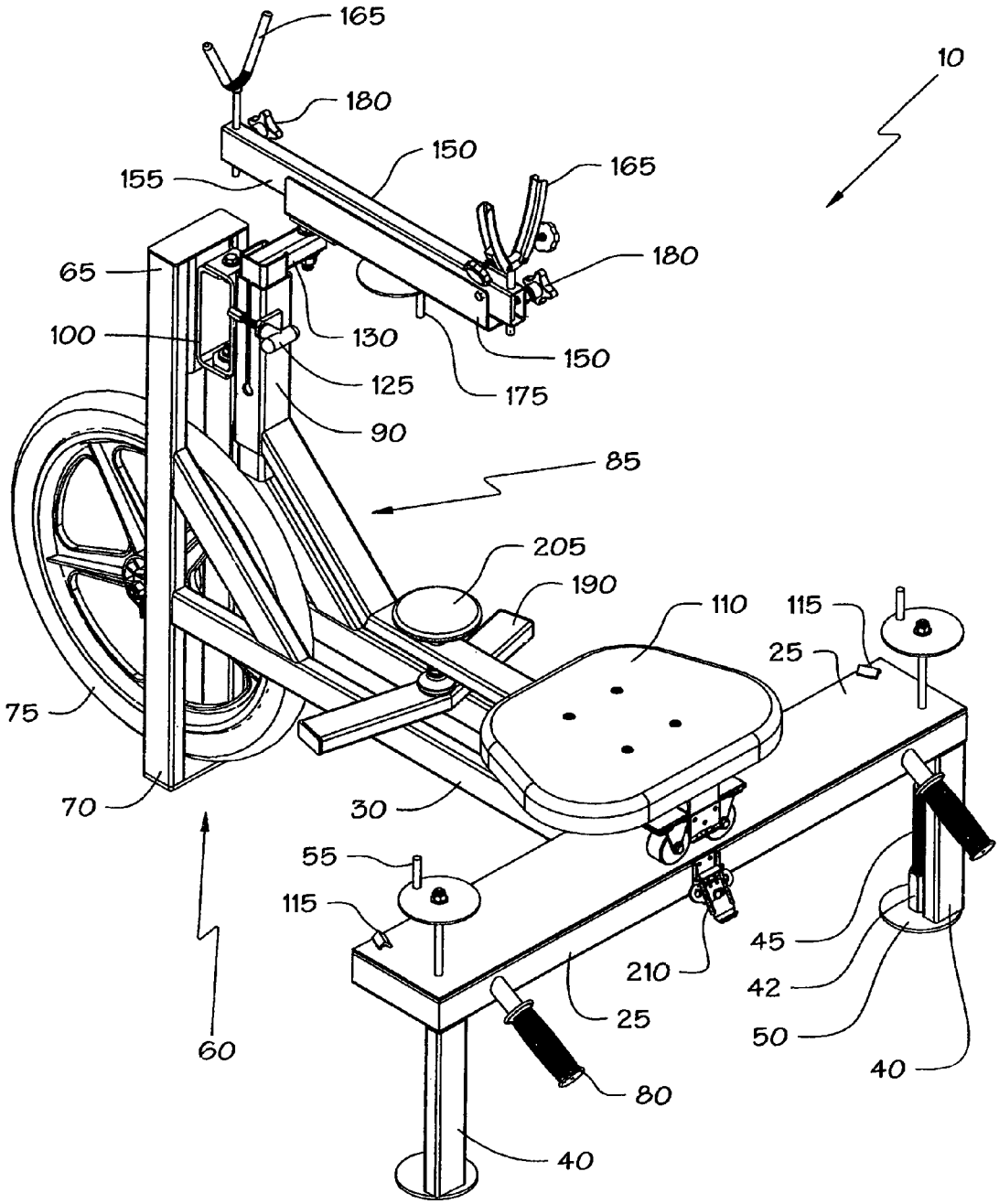
FIG. 1 is a perspective view of the portable shooting bench assembly of the present invention.

| | |
|---|---|
| 10 | Portable Shooting Bench Assembly |
| 15 | Base Chassis Assembly |
| 20 | T-shaped Member |
| 25 | Arm Section of T-shaped Member |
| 30 | Leg Section of T-shaped Member |
| 35 | Adjustable Support Members |
| 40 | Linear Support Upright Member |
| 42 | Threaded Fitting |
| 45 | Threaded Rod Member |
| 50 | Pad Member |
| 55 | Handle Member |
| 60 | Rigid Vertical Support and Wheel Housing Member |
| 65 | Top End of Wheel Housing Member |
| 70 | Bottom End of Wheel Housing Member |
| 75 | Wheel Member |
| 80 | Linear Handle Members |
| 85 | L-Shaped Turret Chassis Member |
| 90 | First End of Turret Chassis Member |
| 95 | Second End of Turret Chassis Member |
| 100 | Mounting Hinge Member |
| 105 | Roller Member |
| 110 | Seat Member |
| 115 | Stop Members |
| 120 | Telescoping Section of Turret Chassis Member |
| 125 | Set Screw for Telescoping Section |
| 130 | Offset Support Arm Member |
| 135 | Aperture in Support Arm Member |
| 140 | Set Screw for Aperture in Support Arm Member |
| 145 | Linear Rifle Support Assembly |
| 150 | Outer U-Shaped Section of Rifle Support Assembly |
| 155 | Inner Section of Rifle Support Assembly |
| 160 | Mounting Rod Member for Rifle Support Assembly |
| 165 | Y-shaped Rifle Support Members |
| 170 | Elevation Adjustment Threaded Rod Member |
| 175 | Handle Member for Elevation Adjustment Rod |
| 180 | Adjustment Knobs for Rifle Support Members |
| 185 | Brake Assembly for Turret Chassis Member |
| 190 | Linear Stationary Member |
| 195 | Brake Member |
| 200 | Threaded Rod Member of Brake Assembly |
| 205 | Handle Member for Adjusting Brake Member |
| 210 | Locking Mechanism for Turret Chassis Assembly |

Construction

The invention is a portable shooting bench assembly, adapted for supporting a firearm weapon and for seating an individual firing the weapon. The portable shooting bench assembly comprises a base chassis assembly that includes a horizontally oriented T-shaped member, having an arm section and a leg section intersecting a midpoint of the arm section. The T-shaped member includes a pair of adjustable support members, with one support member attached vertically at each end of a common side of the arm section. A rigid vertical support and wheel housing member is attached to the leg section opposite the arm section. The support and wheel housing member has a top end extending above the T-shaped member and a bottom end extending below the T-shaped member. A wheel member is mounted vertically within the support and wheel housing member. The adjustable support members and the bottom end of the support and wheel housing member are in contact with a support surface, when the T-shaped member in a horizontal orientation. The wheel member contacts the support surface upon elevating the arm section of the base chassis assembly. An L-shaped turret chassis member, having first and second ends, is pivotally mounted at a first end to the top end of the vertical support and wheel housing member and follows the contour of the base chassis assembly. The turret chassis member's second end extends to the midpoint of the arm section, with the turret chassis member's second end supported on at least one roller member that contacts the arm section of the T-shaped member. A seat member is secured to the turret chassis member's second end opposite the at least one roller member. The seat member is adapted to support an individual as the second end of the turret chassis member pivots in an arc along the arm section of the T-shaped member. The first end of the turret chassis member contains a vertically telescoping section, having an offset support arm member extending to one side thereof. The support arm member is oriented parallel to the T-shaped member's arm section. A linear, rifle support assembly is adjustably secured to the offset arm member, with the rifle support assembly oriented parallel to the T-shaped member's leg section. The rifle support assembly includes a pair of spaced apart rifle supports to cradle a rifle place there upon. Thus, a hunter seated on the seat member moves himself and his rifle positioned in the support assembly by pivoting the second end of the turret chassis assembly on the at least one roller member along the T-shaped member's arm section.

Figure 2:
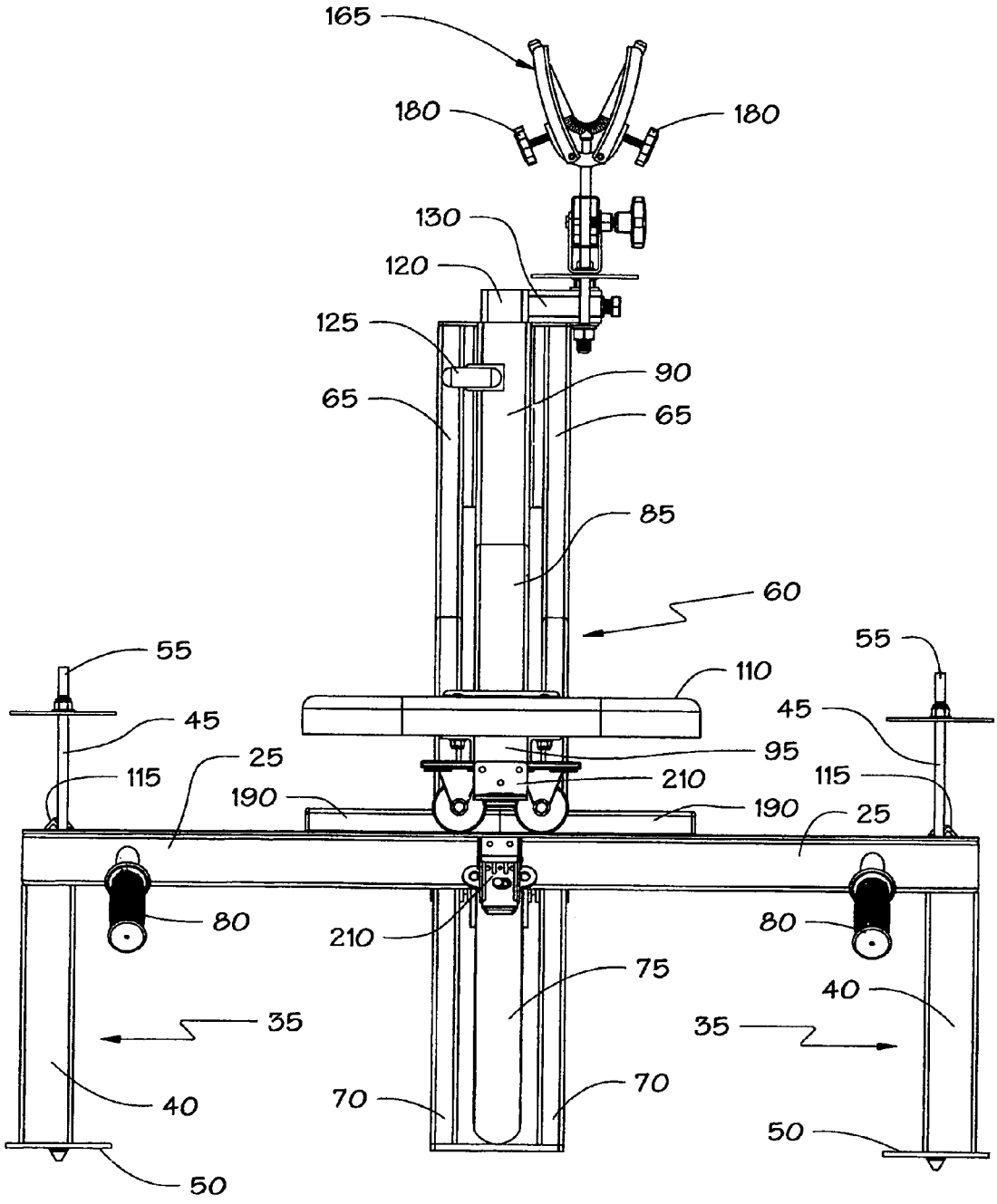
FIG. 2 is a rear view of the portable shooting bench assembly of the present invention.
Figure 3:
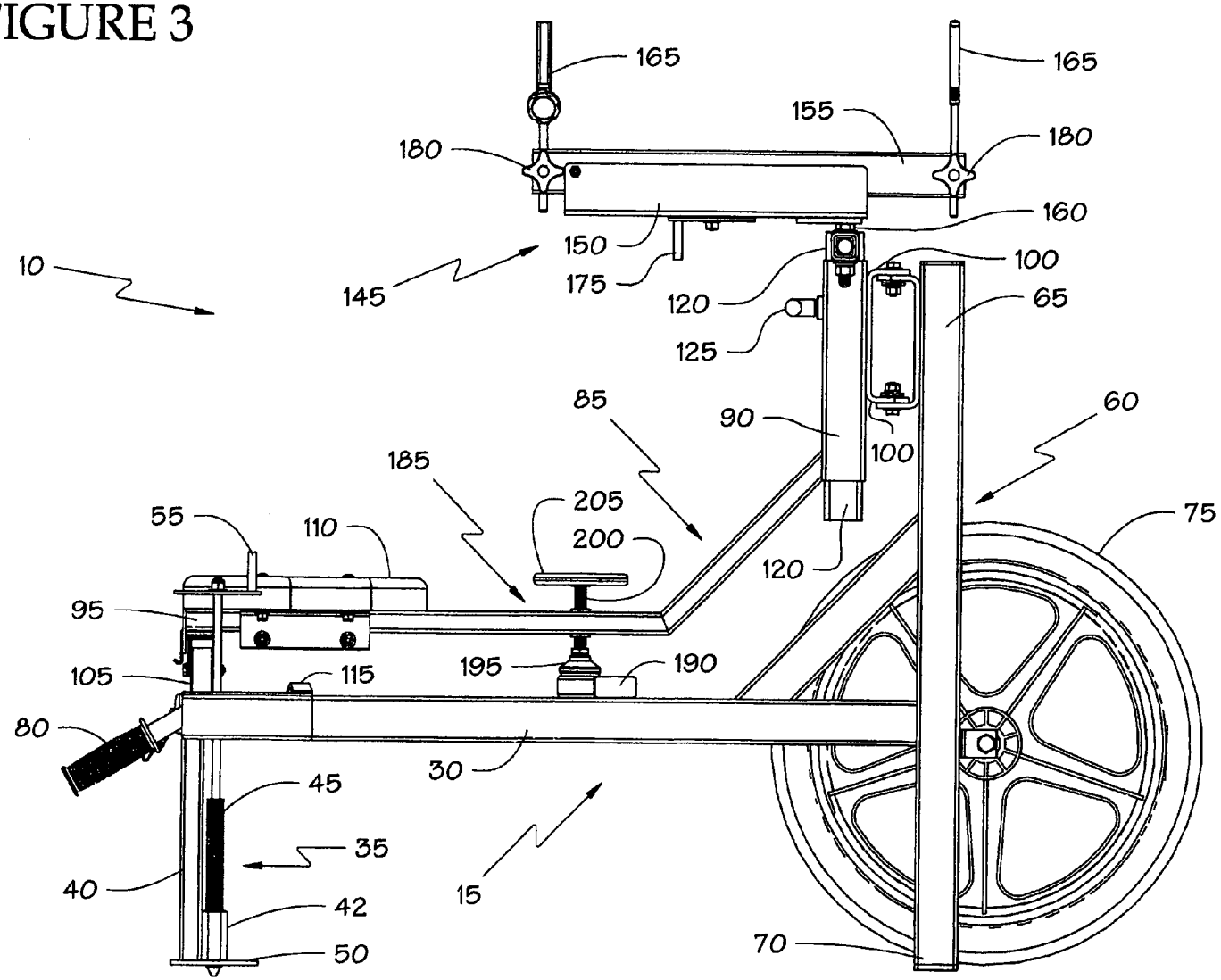
FIG. 3 is a side view of the portable shooting bench assembly of the present invention.

Referring now to FIGS. 1-3, several perspective views of the portable shooting bench assembly of the present invention are shown. The portable shooting bench assembly 10 comprises a base chassis assembly 15 that includes a horizontally oriented T-shaped member 20, having an arm section 25 and a leg section 30 intersecting a midpoint of the arm section 25. The T-shaped member 20 includes a pair of adjustable supported member 35, with one support member 35 attached vertically at each end of a common side of the arm section 25. Each adjustable supported member 35 includes a linear support upright member 40 secured at a first end to the arm section 25 with a threaded fitting 42 fastened at the second end thereof. A threaded rod member 45 is mounted in the threaded fitting 42, with a pad member 50 fastened at one end and extending beyond the second end of the support upright 40 for contact the support surface. The rod member 45 also extends through an aperture in the arm section 25, with a handle member 55 at the end of the rod member 45 opposite the pad member 50. Thus, rotation of the rod member 45 with the handle member 55 raises or lowers the pad member 50 relative to the second end of the support upright 40.

Figure 4:
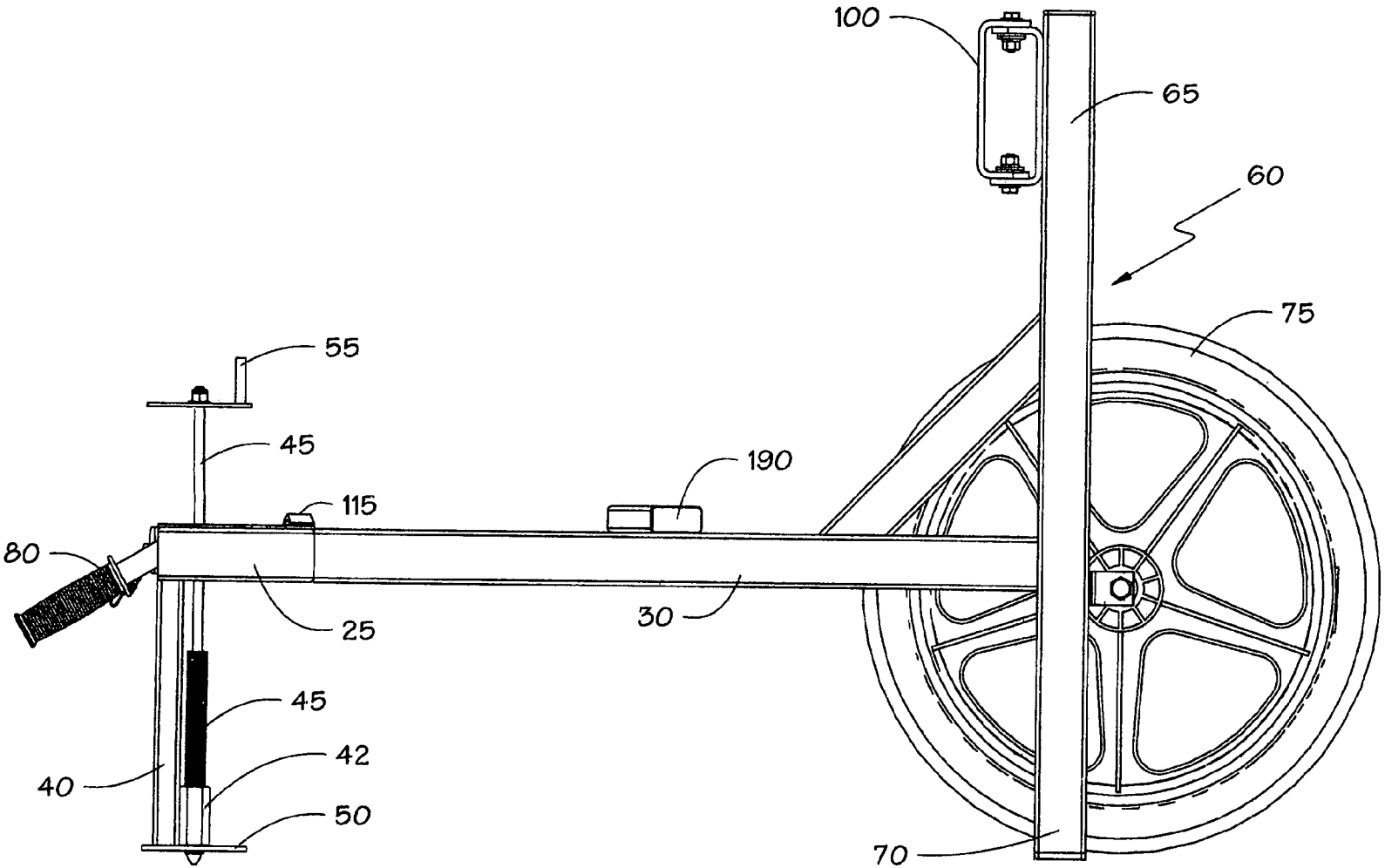
FIG. 4 is a side view of the base chassis assembly of the portable shooting bench assembly of the present invention.

A rigid vertical support and wheel housing member 60 is attached to the leg section 30 opposite the arm section 25. The support and wheel housing member 60 has a top end 65 extending above the T-shaped member 20 and a bottom end 70 extending below the T-shaped member 20. A wheel member 75 is mounted vertically within the support and wheel housing member 60. Preferably, the vertical support and wheel housing member 60 comprises a rectangular box structure with the wheel member 75 mounted within the rectangular box structure, as illustrated in FIGS. 1-3. Thus, the pad members 50 of the adjustable support members 35 and the bottom end 70 of the support and wheel housing member 60 are in contact a support surface with the T-shaped member 20 in a horizontal orientation. The wheel member 75 contacts the support surface upon elevating the arm section 25 of the base chassis assembly 15. To assist in elevating the arm section 25 of the base chassis assembly 15, a pair of linear handle members 80 is secured to the arm section 25 of the T-shaped base chassis assembly 15. Each handle member 80 of the pair is secured near opposite ends of the arm section 25 and adapted for grasping by a user to enable elevating the arm section 25 of the base chassis assembly 15. Thus, the shooting bench assembly 10 is readily transported, with only the wheel member 75 contacting the support surface. The base chassis assembly 15 is shown in FIG. 4.

Figure 5:
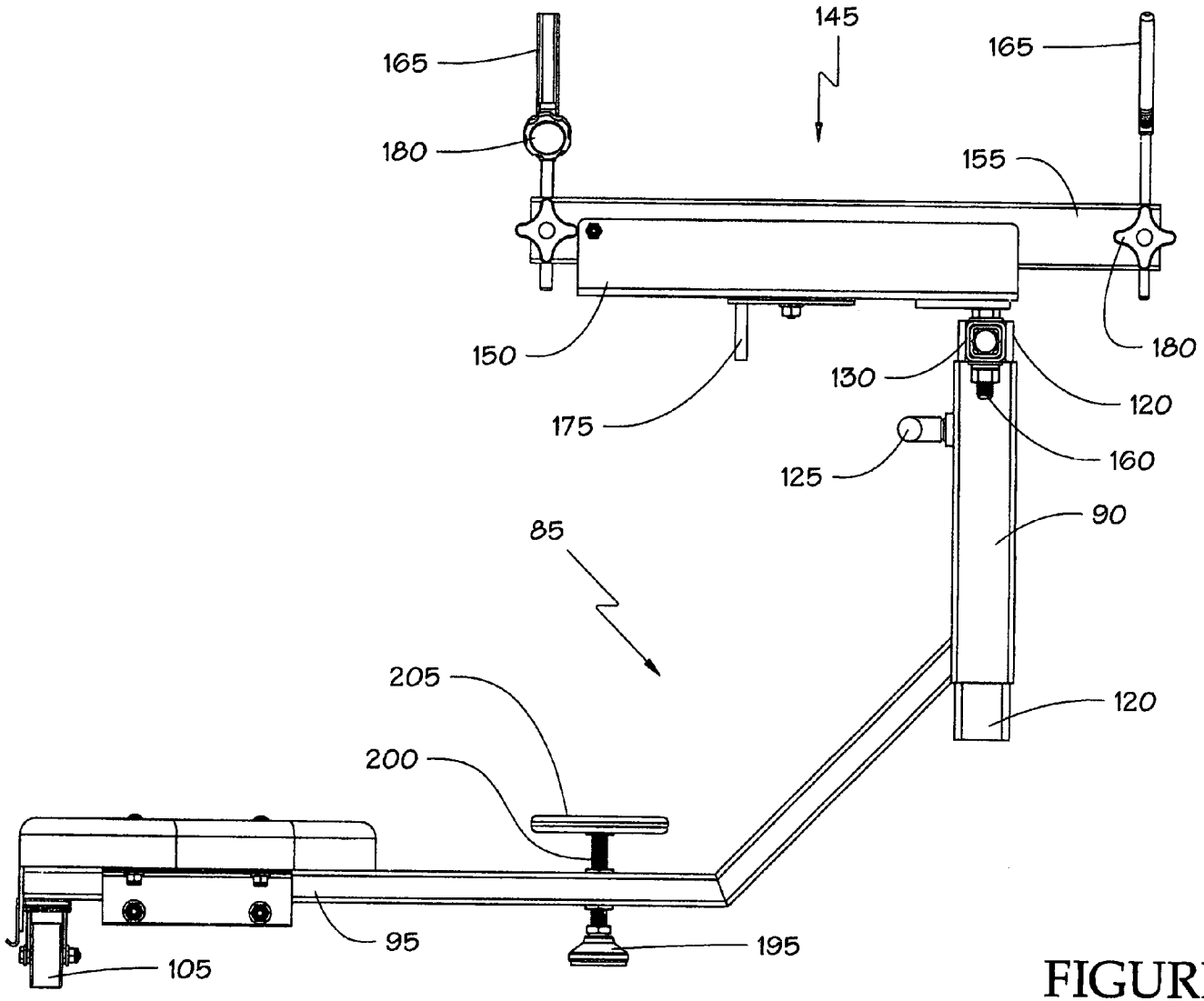
FIG. 5 is a side view of the turret chassis of the portable shooting bench assembly of the present invention.

An L-shaped turret chassis member 85, having a first end 90 and a second end 95, is pivotally mounted at the first end 90 to the top end 65 of the vertical support and wheel housing member 60 and follows the contour of the base chassis assembly 15. Preferably, the pivotal mounting is provided by a mounting hinge member 100, securing the first end 90 of the turret chassis member 85 to the top end 65 of the vertical support and wheel housing member 60. The turret chassis member's second end 95 extends to the midpoint of the arm section 25, with the turret chassis member's second end 95 supported on at least one roller member 105 that contacts the arm section 25 of the T-shaped member 20. A seat member 110 is secured to the turret chassis member's second end 95, opposite the at least one roller member 105 attached thereto. The seat member 110 is adapted to support an individual as the second end 95 of the turret chassis member 85 pivots in an arc along the arm section 25 of the T-shaped member 20. Additionally, stop members 115 are secured to the arm section 25 of the T-shaped member 20, with the stop members 115 bracketing the second end 95 of the turret chassis member 85 to limit movement of the at least one roller member 105 on the arm section 25 of the T-shaped member 20. Thus, the at least one roller member 105 is prevented from moving beyond the edge of the arm section 25. Although the seat member 110 is shown as a relatively flat structure, the seat member 110 may include a vertical backrest (not shown) for additional support of the hunter seated thereon. The turret chassis member 85 is shown in greater detail in FIG. 5.

The first end 90 of the turret chassis member 85 contains a vertically telescoping section 120 having an offset support arm member 130 extending to one side thereof. Extension of the telescoping section 120 is controlled by a set screw 125 mounted in the first end 90 of the turret chassis member 85. Alternatively, the first end 90 of the turret chassis member 85 is slotted and includes a bolt that pinches the slotted first end 90 around the telescoping section 120. The support arm member 130 is oriented parallel to the T-shaped member's arm section 25. A linear, rifle support assembly 145 is adjustably secured to the offset arm member 130, with the rifle support assembly 145 oriented parallel to the T-shaped member's leg section 30. The rifle support assembly 145 includes a mounting rod member 160 extending from the bottom thereof, with the mounting rod member 160 fitting into an aperture 135 in the support arm member 130. A set screw 140, or similar fastener, adjustably secures the mounting rod member 160 within the aperture 135.

Figure 6:
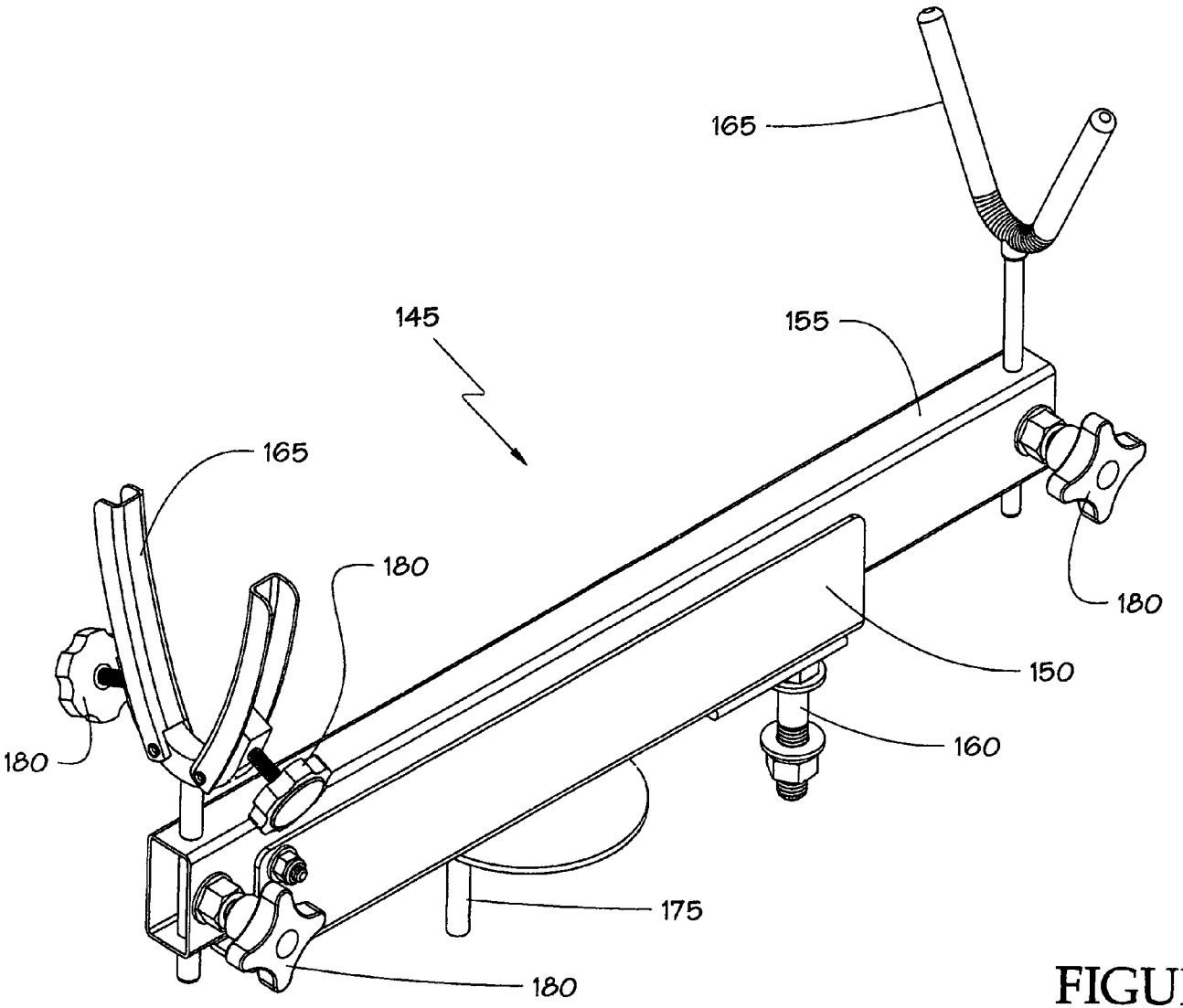
FIG. 6 is a perspective view of the rifle support assembly of the portable shooting bench assembly of the present invention

The rifle support assembly 145 includes a pair of spaced apart, Y-shaped, rifle supports 165 to cradle a rifle place there upon. The rifle supports 165 are vertically adjustable by means of adjustment knobs 180 contained in the support assembly 145. In a preferred embodiment, the linear rifle support assembly 145 includes nested, inner and outer sections. Preferably, the outer section 150 is U-shaped, with the inner section 155 pivotally secured at one end to the outer U-shaped section 150. A threaded rod member 170, mounted in a treaded aperture in the outer section 150, provides for elevating the end of the inner section 155 opposite the pivotally secured end thereof. A handle member 175, attached to the threaded rod member 170, is provided to manually rotate the rod member 170. The rifle support assembly 145 is shown in greater detail in FIG. 6.

In a further embodiment of the invention, the portable shooting bench assembly 10 includes a brake assembly 185 for anchoring the turret chassis member 85 at a selected position. The brake assembly 185 includes a linear, stationary member 190 secured perpendicularly to the T-shaped member's leg section 30 and parallel to the T-shaped member's arm section 25. A brake member 195 is adjustably secured to the turret chassis member 85. The brake member 195 is fastened to a thread rod member 200, mounted in the turret chassis member 85. A handle member 205 is located at the end of the rod member 200 opposite the brake member 195 for rotating the rod member 200 to vary the position of the brake member 195. Thus, movement of the brake member 195 into contact with the stationary member 190 prevents pivoting of the turret chassis member 85 relative to the base chassis assembly 15.

While the invention has been particularly shown and described with reference to preferred embodiments thereof, it will be understood by those skilled in the art that various changes in form and details may be made therein without departing from the spirit and scope of the invention.

I claim:

1. A portable shooting bench assembly comprising:

a base chassis assembly including;

a horizontally oriented T-shaped member having an arm section and a leg section intersecting a midpoint of the arm section, the T-shaped member including a pair of adjustable support members, one adjustable support member attached vertically at each end of a common side of the arm section, a rigid, vertical support and wheel housing member attached to the leg section opposite the arm section, the support and wheel housing member having a top end extending above the T-shaped member and a bottom end extending below the T-shaped member;

a wheel member mounted vertically within the vertical support and wheel housing member, the adjustable support members and the bottom end of the support and wheel housing member in contact with a support surface with the T-shaped member in a horizontal orientation, the wheel member contacting the support surface upon elevating the arm section of the base chassis assembly;

an L-shaped turret chassis member having first and second ends, the turret chassis member pivotally mounted at a first end to the top end of the vertical support and wheel housing member and following the contour of the base chassis assembly with the turret chassis member's second end extending to the midpoint of the arm section, the turret chassis member's second end supported on at least one roller member that contacts the arm section of the T-shaped member;

a seat member secured to the turret chassis member's second end opposite the at least one roller member, the seat member adapted to support an individual as the second end of the turret chassis member pivots in an arc along the arm section of the T-shaped member;

the first end of the turret chassis member including a vertically telescoping section having an offset support arm member extending to one side thereof, the support arm member oriented parallel to the T-shaped member's arm section; and a linear, rifle support assembly adjustably secured to the offset arm member, the rifle support assembly oriented parallel to the T-shaped member's leg section, the rifle support assembly including a pair of spaced apart rifle supports to cradle a rifle place there upon;

whereby a hunter seated on the seat member moves himself and his rifle positioned in the support assembly by pivoting the second end of the turret chassis assembly on the at least one roller member along the T-shaped member's arm section.

2. The portable shooting bench assembly of claim 1, further including a pair of handle members secured to the arm section of the T-shaped base chassis assembly, each handle member of the pair secured near opposite ends of the arm section and adapted for grasping by a user to enable elevating the arm section of the base chassis assembly.

3. The portable shooting bench assembly of claim 1, wherein each adjustable support member attached vertically at each end of a common side of the arm section includes a linear support upright member secured at a first end to the arm section, with a threaded fitting fastened at the second end thereof; a threaded rod member mounted in the threaded fitting with a pad member fastened at a first end thereof, the pad member positioned beyond the second end of the support upright and adapted for contact the support surface; and the rod member extending through an aperture in the arm section with a handle member at a second end of the rod member opposite the pad member.

4. The portable shooting bench assembly of claim 1, wherein the vertical support and wheel housing member includes a rectangular box structure with the wheel member mounted within the rectangular box structure.

5. The portable shooting bench assembly of claim 1, wherein the vertically telescoping section with offset support arm extending to one side of the turret chassis member and parallel to the T-shaped member's arm section is removable from the turret chassis member, allowing the offset support arm to extend to either side of the turret chassis member.

6. The portable shooting bench assembly of claim 1, further including stop members secured to the arm section of the T-shaped member and bracketing the second end of the turret chassis member to limit movement of the at least one roller member on the arm section of the T-shaped member.

7. The portable shooting bench assembly of claim 1, wherein the linear rifle support assembly includes nested, inner and outer sections, with the inner section pivotally secured at one end to the outer section, and a threaded rod mounted within a treaded aperture in the outer section for elevating an end of the inner section opposite the pivotally secured end thereof.

8. A portable shooting bench assembly comprising:

a base chassis assembly including;

a horizontally oriented T-shaped member having an arm section and a leg section intersecting a midpoint of the arm section, the T-shaped member including a pair of adjustable support members, one adjustable support member attached vertically at each end of a common side of the arm section, a rigid, vertical support and wheel housing member attached to the leg section opposite the arm section, the support and wheel housing member having a top end extending above the T-shaped member and a bottom end extending below the T-shaped member;

a wheel member mounted vertically within the vertical support and wheel housing member, the adjustable support members and the bottom end of the support and wheel housing member in contact with a support surface with the T-shaped member in a horizontal orientation, the wheel member contacting the support surface upon elevating the arm section of the base chassis assembly;

an L-shaped turret chassis member having first and second ends, the turret chassis member pivotally mounted at a first end to the top end of the vertical support and wheel housing member and following the contour of the base chassis assembly with the turret chassis member's second end extending to the midpoint of the arm section, the turret chassis member's second end supported on at least one roller member that contacts the arm section of the T-shaped member;

a seat member secured to the turret chassis member's second end opposite the at least one roller member, the seat member adapted to support an individual as the second end of the turret chassis member pivots in an arc along the arm section of the T-shaped member;

a brake assembly for anchoring the turret chassis member at a selected position, the brake assembly including a linear, stationary member secured perpendicularly to the T-shaped member's leg section and parallel to the T-shaped member's arm section, with a brake member adjustably secured to the turret chassis member, whereby movement of the brake member into contact with the stationary member prevents pivoting of the turret chassis member relative to the base chassis assembly;

the first end of the turret chassis member including a vertically telescoping section having an offset support arm member extending to one side thereof, the support arm member oriented parallel to the T-shaped member's arm section; and a linear, rifle support assembly adjustably secured to the offset arm member, the rifle support assembly oriented parallel to the T-shaped member's leg section, the rifle support assembly including a pair of spaced apart rifle supports to cradle a rifle place there upon;

whereby a hunter seated on the seat member moves himself and his rifle positioned in the support assembly by pivoting the second end of the turret chassis assembly on the at least one roller member along the T-shaped member's arm section.

9. The portable shooting bench assembly of claim 8, further including a pair of handle members secured to the arm section of the T-shaped base chassis assembly, each handle member of the pair secured near opposite ends of the arm section and adapted for grasping by a user to enable elevating the arm section of the base chassis assembly.

10. The portable shooting bench assembly of claim 8, wherein each adjustable supported member attached vertically at each end of a common side of the arm section includes a linear support upright member secured at a first end to the arm section, with a threaded fitting fastened at the second end thereof; a threaded rod member mounted in the threaded fitting with a pad member fastened at a first end thereof, the pad member positioned beyond the second end of the support upright and adapted for contact the support surface; and the rod member extending through an aperture in the arm section with a handle member at a second end of the rod member opposite the pad member.

11. The portable shooting bench assembly of claim 8, wherein the vertical support and wheel housing member includes a rectangular box structure with the wheel member mounted within the rectangular box structure.

12. The portable shooting bench assembly of claim 8, wherein the vertically telescoping section with offset support arm extending to one side of the turret chassis member and parallel to the T-shaped member's arm section is removable from the turret chassis member, allowing the offset support arm to extend to either side of the turret chassis member.

13. The portable shooting bench assembly of claim 8, further including stop members secured to the arm section of the T-shaped member and bracketing the second end of the turret chassis member to limit movement of the at least one roller member on the arm section of the T-shaped member.

14. The portable shooting bench assembly of claim 8, wherein the linear rifle support assembly includes nested, inner and outer sections, with the inner section pivotally secured at one end to the outer section, and a threaded rod mounted within a treaded aperture in the outer section for elevating an end of the inner section opposite the pivotally secured end thereof.

15. A portable shooting bench assembly comprising:

a base chassis assembly including;

a horizontally oriented T-shaped member having an arm section and a leg section intersecting a midpoint of the arm section, the T-shaped member including a pair of adjustable support members, one adjustable support member attached vertically at each end of a common side of the arm section, a rigid, vertical support and wheel housing member attached to the leg section opposite the arm section, the support and wheel housing member having a top end extending above the T-shaped member and a bottom end extending below the T-shaped member;

a wheel member mounted vertically within the vertical support and wheel housing member, the adjustable support members and the bottom end of the support and wheel housing member in contact with a support surface with the T-shaped member in a horizontal orientation, the wheel member contacting the support surface upon elevating the arm section of the base chassis assembly;

a pair of handle members secured to the arm section of the T-shaped base chassis assembly, each handle member of the pair secured near opposite ends of the arm section and adapted for grasping by a user to enable elevating the arm section of the base chassis assembly;

an L-shaped turret chassis member having first and second ends, the turret chassis member pivotally mounted at a first end to the top end of the vertical support and wheel housing member and following the contour of the base chassis assembly with the turret chassis member's second end extending to the midpoint of the arm section, the turret chassis member's second end supported on at least one roller member that contacts the arm section of the T-shaped member;

a seat member secured to the turret chassis member's second end opposite the at least one roller member, the seat member adapted to support an individual as the second end of the turret chassis member pivots in an arc along the arm section of the T-shaped member;

stop members secured to the arm section of the T-shaped member and bracketing the second end of the turret chassis member to limit movement of the at least one roller member on the arm section of the T-shaped member;

a brake assembly for anchoring the turret chassis member at a selected position, the brake assembly including a linear, stationary member secured perpendicularly to the T-shaped member's leg section and parallel to the T-shaped member's arm section, with a brake member adjustably secured to the turret chassis member, whereby movement of the brake member into contact with the stationary member prevents pivoting of the turret chassis member relative to the base chassis assembly;

the first end of the turret chassis member including a vertically telescoping section having an offset support arm member extending to one side thereof, the support arm member oriented parallel to the T-shaped member's arm section; and a linear, rifle support assembly adjustably secured to the offset arm member, the rifle support assembly oriented parallel to the T-shaped member's leg section, the rifle support assembly including a pair of spaced apart rifle supports to cradle a rifle place there upon;

whereby a hunter seated on the seat member moves himself and his rifle positioned in the support assembly by pivoting the second end of the turret chassis assembly on the at least one roller member along the T-shaped member's arm section.

16. The portable shooting bench assembly of claim 15, wherein each adjustable supported member attached vertically at each end of a common side of the arm section includes a linear support upright member secured at a first end to the arm section, with a threaded fitting fastened at the second end thereof; a threaded rod member mounted in the threaded fitting with a pad member fastened at a first end thereof, the pad member positioned beyond the second end of the support upright and adapted for contact the support surface; and the rod member extending through an aperture in the arm section with a handle member at a second end of the rod member opposite the pad member.

17. The portable shooting bench assembly of claim 15, wherein the vertical support and wheel housing member includes a rectangular box structure with the wheel member mounted within the rectangular box structure.

18. The portable shooting bench assembly of claim 15, wherein the vertically telescoping section with offset support arm extending to one side of the turret chassis member and parallel to the T-shaped member's arm section is removable from the turret chassis member, allowing the offset support arm to extend to either side of the turret chassis member.

19. The portable shooting bench assembly of claim 15, wherein the linear rifle support assembly includes nested, inner and outer U-shaped sections, with the inner section pivotally secured at one end to the outer section, and a threaded rod mounted within a treaded aperture in the outer section for elevating an end of the inner section opposite the pivotally secured end thereof.

* * * * *